US011321980B1

(12) United States Patent
Tobias et al.

(10) Patent No.: US 11,321,980 B1
(45) Date of Patent: May 3, 2022

(54) SECURITY SYSTEM

(71) Applicants: Marc Tobias, Pittsburgh, PA (US); Tobias Bluzmanis, Miramar, FL (US)

(72) Inventors: Marc Tobias, Pittsburgh, PA (US); Tobias Bluzmanis, Miramar, FL (US)

( * ) Notice: Subject to any disclaimer, the term of this patent is extended or adjusted under 35 U.S.C. 154(b) by 0 days.

(21) Appl. No.: 17/151,268

(22) Filed: Jan. 18, 2021

Related U.S. Application Data

(60) Provisional application No. 62/970,453, filed on Feb. 5, 2020.

(51) Int. Cl.

| | |
|---|---|
| ***G07C 9/00*** | (2020.01) |
| ***E05B 45/00*** | (2006.01) |
| ***E05G 1/10*** | (2006.01) |
| ***E05B 45/06*** | (2006.01) |
| ***E05B 65/00*** | (2006.01) |
| ***E05B 47/00*** | (2006.01) |

(52) U.S. Cl.
CPC ..... *G07C 9/00563* (2013.01); *E05B 45/06* (2013.01); *E05B 47/0002* (2013.01); *E05B 65/0075* (2013.01); *E05G 1/10* (2013.01); *G07C 9/00912* (2013.01); *E05B 2047/0068* (2013.01); *E05B 2047/0069* (2013.01)

(58) Field of Classification Search
CPC . G07C 9/00563; G07C 9/00912; E05B 45/06; E05B 47/0002; E05B 65/0075; E05B 2047/0068; E05B 2047/0069; E05G 1/10
See application file for complete search history.

(56) References Cited

U.S. PATENT DOCUMENTS

| | | | | |
|---|---|---|---|---|
| 5,381,685 | A | 1/1995 | Carl | |
| 5,667,187 | A | 9/1997 | Doman | |
| 6,305,656 | B1 | 10/2001 | Wemyss | |
| 6,552,650 | B1 | 4/2003 | Gokcebay | |
| 6,624,750 | B1 * | 9/2003 | Marman | G08B 26/007 340/521 |
| 7,034,654 | B2 | 4/2006 | Forest | |
| 7,958,758 | B2 | 6/2011 | Trempala | |
| 8,122,746 | B2 | 2/2012 | Hyatt, Jr. | |
| 8,860,568 | B1 * | 10/2014 | Baker | G08B 13/06 340/517 |
| 10,403,122 | B2 | 9/2019 | Fawcett | |
| 10,423,136 | B2 | 9/2019 | Davis | |

(Continued)

FOREIGN PATENT DOCUMENTS

| | | |
|---|---|---|
| CA | 2061455 | 8/1993 |
| CA | 2133743 | 10/1993 |

*Primary Examiner* — Thomas D Alunkal
(74) *Attorney, Agent, or Firm* — Jeffrey A. Proehl; Woods, Fuller, Shultz & Smith, PC

(57) ABSTRACT

A system may comprise an alarm apparatus for a premises and a security container apparatus including a housing defining an interior for receiving objects and a securing door movable between open and closed conditions. The container apparatus may also include control elements configured to control operation of the security container apparatus, and the control elements may control operation of aspects of the alarm apparatus. The container apparatus may also include sensing elements configured to sense characteristics of the security container apparatus, and the sensing elements may be in communication with at least one element of the control elements.

20 Claims, 2 Drawing Sheets

(56) References Cited

U.S. PATENT DOCUMENTS

| | | | | |
|---|---|---|---|---|
| 2007/0126562 | A1* | 6/2007 | Ku | B60R 25/24 340/426.2 |
| 2007/0229962 | A1 | 10/2007 | Mason, Jr. | |
| 2009/0165682 | A1* | 7/2009 | Cleveland | G06F 21/86 710/1 |
| 2013/0316114 | A1 | 11/2013 | Hwang | |
| 2014/0085773 | A1 | 3/2014 | Chernukhin | |
| 2015/0242895 | A1 | 8/2015 | Brown | |
| 2015/0284986 | A1* | 10/2015 | Wall | E05G 1/024 109/38 |
| 2016/0189527 | A1* | 6/2016 | Peterson | G08B 31/00 340/541 |
| 2016/0194913 | A1* | 7/2016 | Stevenson | E05B 63/0065 340/568.6 |
| 2016/0203687 | A1* | 7/2016 | Lee | G08B 13/08 340/545.2 |
| 2016/0343224 | A1 | 11/2016 | Markwell | |
| 2016/0378140 | A1 | 12/2016 | Bergmann | |
| 2017/0312578 | A1 | 11/2017 | Tran | |
| 2018/0301004 | A1* | 10/2018 | Lee | G08B 13/08 |

* cited by examiner

SECURITY SYSTEM

REFERENCE TO RELATED APPLICATIONS

This application claims the priority benefit of U.S. Provisional Patent Application No. 62/970,453, filed Feb. 5, 2020, which is hereby incorporated by reference in its entirety.

BACKGROUND

Field

The present disclosure relates to alarm and security apparatus and more particularly pertains to a new security system which may integrate functionality of a security container apparatus and a premises security apparatus.

SUMMARY

In one aspect, the present disclosure relates to a system comprising an alarm apparatus configured to provide security to at least a portion of a building structure and a security container apparatus. The container apparatus may comprise a housing defining an interior for receiving objects with an opening from an exterior of the housing into the interior. The container apparatus may include a securing door movable between a closed condition in which the door closes the opening in the housing against access to the interior and an open condition in which the door does not close the opening and does not restrict access to the interior of the housing. The container apparatus may include control elements configured to control operation of the security container apparatus, with the control elements being configured to control operation of aspects of the alarm apparatus and the control elements each being integrated into at least one of the housing and the securing door. The container apparatus may also comprise sensing elements configured to sense characteristics of the security container apparatus, the sensing elements being in communication with at least one element of the control elements.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
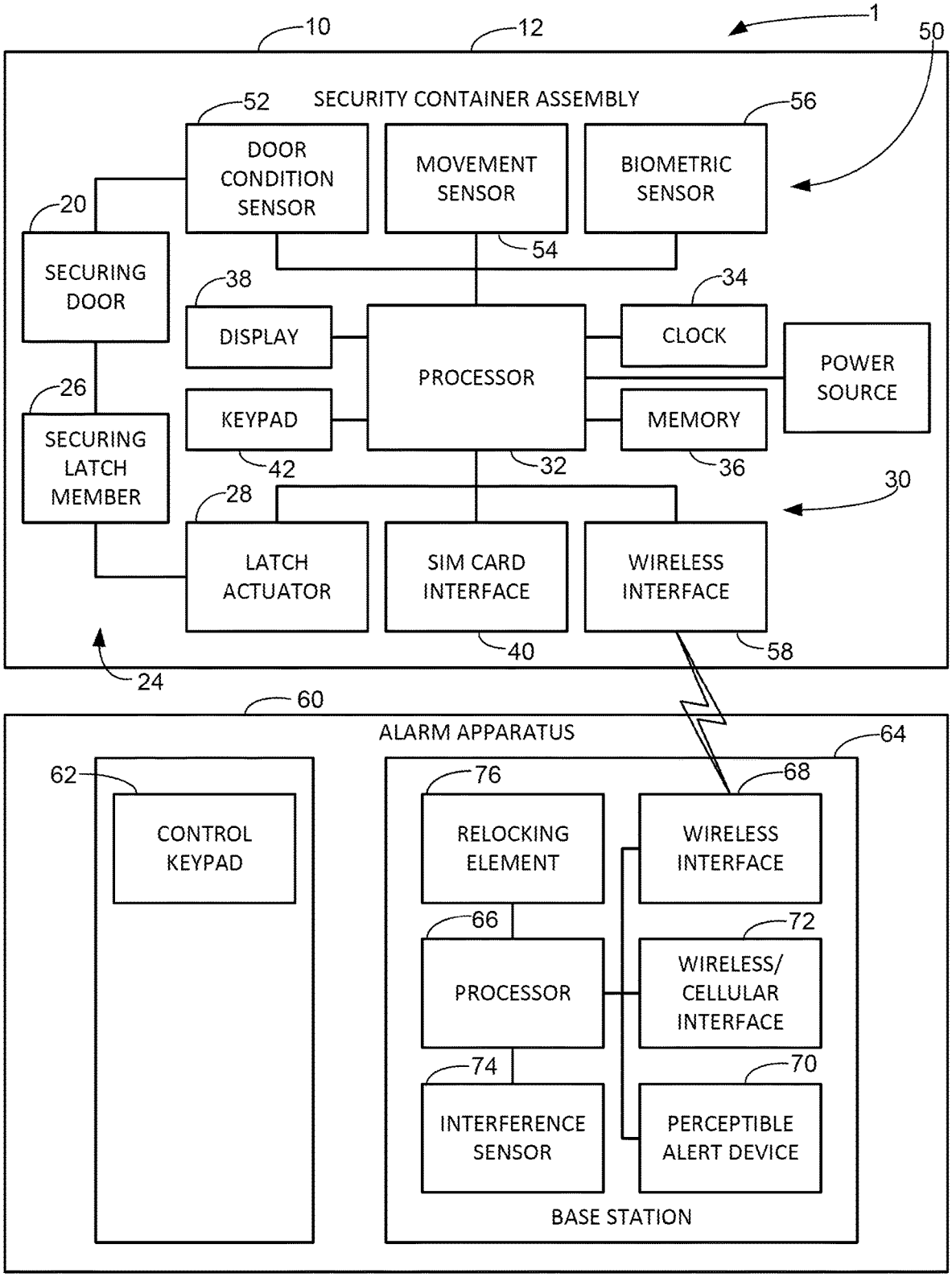
FIG. 1 is a schematic diagram of a new security system according to the present disclosure.
Figure 2:
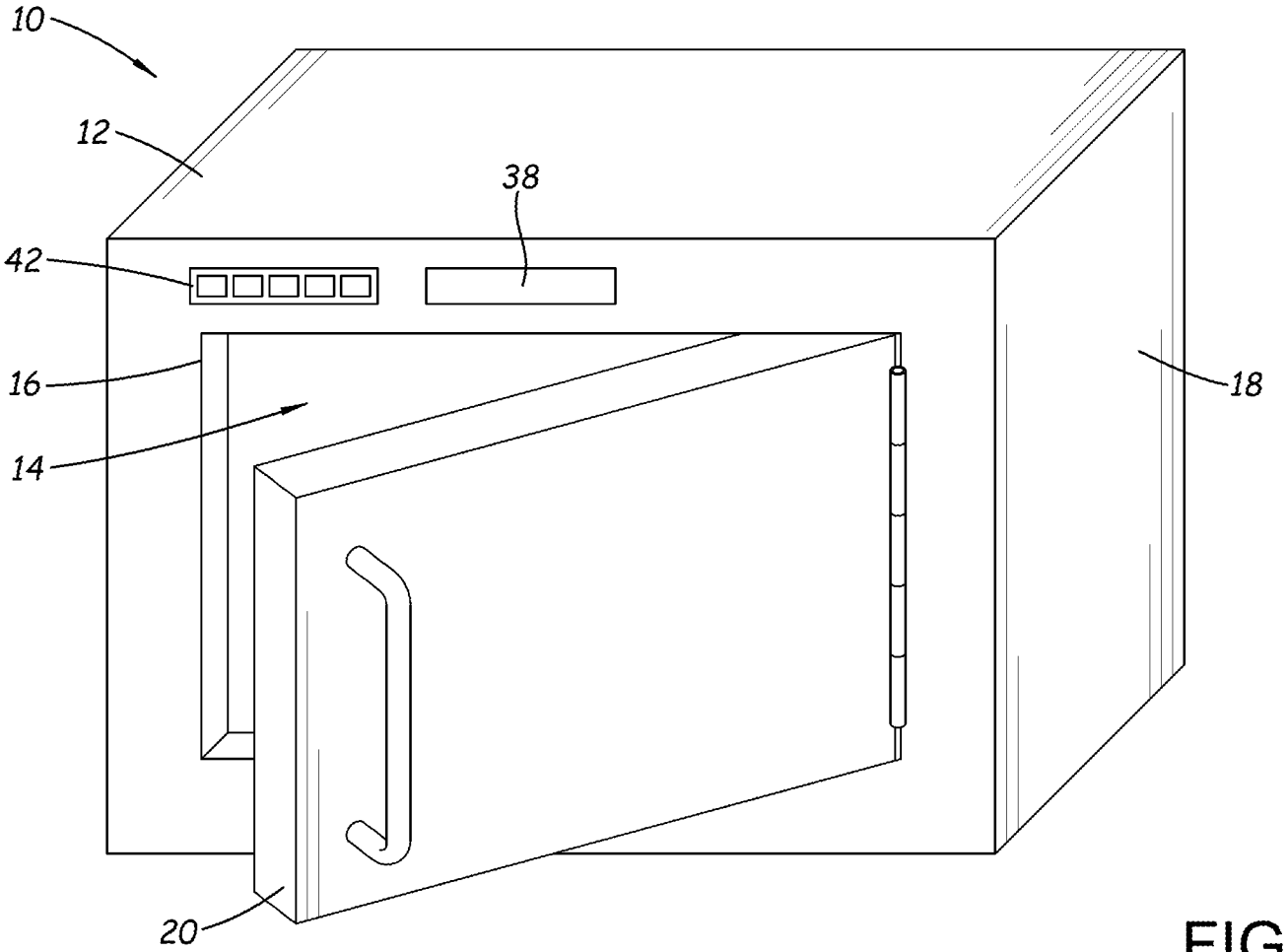
FIG. 2 is a schematic perspective view of the security container apparatus of the security system, according to an illustrative embodiment.

With reference now to the drawings, and in particular to FIGS. 1 and 2 thereof, a new security system embodying the principles and concepts of the disclosed subject matter will be described.

The applicants have recognized that traditional home safes, and the burglar/fire alarm systems employed to protect the homes in which the home safes are located, function independently of each other and thus utilize separate control systems and require two distinct access systems.

The applicants have devised a system in which various functions of a premises security apparatus may be controlled from a device such as a security container apparatus with various control inputs and sensors. For example, entry and exit and alert functionality of the premises security apparatus may be operated from the security container apparatus using inputs such as a keypad and a biometric sensor. The single internal keypad, software and hardware communicates and controls internal locking systems in the safe and interacts wirelessly with a full featured commercially available alarm system. Convenience and security are assured to the user or owner of both systems through their functionality integration.

In aspects of the disclosure, a system 1 will be described that may include a security container apparatus 10 and an alarm apparatus 60, although it should be understood that the system may comprise only one of these apparatus, or multiple apparatus of the same type.

The security container apparatus 10 of the system 1 may be capable of receiving and selectively securing objects for which it is desirable to secure, such as valuable items, weapons, significant papers, or virtually any other object or item for which control of access is desired. In general, the security container apparatus 10 may include a housing 12 which defines an interior 14 for receiving the object or objects to be secured, and has an opening 16 extending from the exterior of the housing 12 into the interior 14. The housing 12 may have a perimeter wall 18 which forms, for example, a top, a bottom, sides extending between the top and bottom, a rear extending between the top and bottom and between the sides, and may also form at least a portion of a front of the housing. Illustratively, the opening 16 may be positioned in the front of the housing, or in the top of the housing, or in any other suitable portion of the perimeter wall 18. Those skilled in the art will recognize that other geometric configurations may be utilized to equivalent effect.

The security container apparatus 10 may also include a securing door 20 which may be mounted on the housing and may be movable with respect to the housing, or the door may be completely removable with respect to the perimeter wall 18 of the housing. The securing door 20 may be movable between a closed condition in which the door closes the opening 16 in the housing and restricts the ability to access to the interior 14, and an open condition in which the door 20 does not close the opening and thus does not effectively restrict access to the interior of the housing. In some embodiments, the door 20 may be mounted on the housing 12 in a manner that permits movement of the door between the open and closed conditions without completely separating the door from the housing (e.g., via a hinge), and in other embodiments the door may be completely separable from the housing to move the door between the closed and the open condition.

The security container apparatus 10 may also include a securing latch assembly 24 which is configured to selectively latch or secure the securing door 20 in the closed condition, and release the door from the closed condition to permit movement of the door toward the open condition. The securing latch assembly 24 may have a latched condition and an unlatched condition, with the latched condition generally corresponding to the securing door being held in the closed condition with respect to the housing, and the unlatched condition of assembly 24 which permits the door 22 to be essentially freely moved between the open and closed conditions.

The securing latch assembly 24 may include a latch member 26 which is mounted on either the housing 12 or the securing door 20, and is movable with respect to the housing or door on which it is mounted to selectively engage structure formed on the other element of the housing or door. Illustratively, the securing latch assembly 24 may be mounted on the housing 12 and be operable to selectively engage the door, although the opposite relationship may also be utilized. The latch member 26 may be movable between a latched position which generally corresponds to the latched condition of the assembly 24 and an unlatched position which generally corresponds to the unlatched condition of the assembly 24. The securing latch assembly 24 may also include a latch actuator 28 which is configured to act upon the latch member 26 to move the latch member between the latched and unlatched positions and effectively change the latch assembly 24 between the latched and unlatched conditions. Illustratively, the latch actuator 28 may comprise an actuating solenoid, although other types of actuators or mechanisms may be utilized to produce a change in the condition of the latch member 26.

The security container apparatus 10 may also include control elements 30 which may be configured to control various aspects of the operation of the apparatus 10, and may also suitably be configured to control operation of other elements of the system, such as various aspects of the operation of the alarm apparatus described in this disclosure. The control elements 30 may be integrated into at least one of the housing 12 and the securing door 20, and optionally can be integrated into both the housing and the securing door. The control elements 30 may include a microprocessor 32 for receiving signals and transmitting signals, as well as executing commands, a clock 34 which is configured to output temporal information and may be in communication with the microprocessor (or may be integrated into the microprocessor), memory 36 in communication with the microprocessor (optionally separate of, or integral to, the microprocessor). The control elements 30 may also include a display 38 which is configured to display information in a visual form to a user or operator of the system 1, and may be in communication with the microprocessor or other suitable display circuitry to generate characters, images, etc. The display 38 may include a screen utilizing technologies such as liquid crystal diode (LCD), light-emitting diode (LED), etc., and the display may also include discrete lights typically formed using LEDs.

The control elements 30 may also include a subscriber identity module (SIM) card interface 40 which may be configured to receive a SIM card inserted into the interface for receiving information from the SIM card which may facilitate authentication of the elements of the security container apparatus 10 to other elements of the system 1, such as the alarm system 60. The control elements 30 may also include a keypad 42 which is configured to receive commands from a user of the system 1, and those commands may be utilized for operation of the container apparatus 10 as well as operation of the alarm system 60. The keypad 42 may be in communication with the microprocessor 32 to receive input and commands from the keypad. Commands and instructions receivable through the keypad may include, for example, a command to change the securing latch assembly from the latched condition to the unlatched condition (and vice versa), a request to set and delete passwords, a command to require dual passwords for access, a command to impose a lockout of access after a predetermined number of invalid code entries on the keypad, a command to arm or disarm the alarm system 60, a command to transmit a duress signal, a command to notify an authorized person for the alarm system of invalid or unauthorized attempts to enter or access the interior 14 of the apparatus 10, a command to impose a time delay before the securing door can be opened or released from the closed condition, as well as other commands for other functionality.

The security container apparatus 10 may also include sensing elements 50 which are configured to sense various conditions which may be related to operation of the system 1. The sensing elements 50 may be in communication with at least one element of the control elements, 30 such as the microprocessor 32. The sensing elements 50 may each be capable of generating signals which are characteristic of conditions sensed by the respective sensing elements. In some embodiments, the sensing elements 50 may include a door condition sensor 52 which is configured to sense a condition of the securing door 20 with respect to the opening 16 of housing 12. For example, the door condition sensor 52 may be configured to detect if the securing door is (or is not) in the closed condition, and may also be able to detect if the securing door is in the open condition. The door condition sensor 52 may generate a door condition signal which is indicative of the condition of the door. Illustratively, the door condition sensor 52 may be in communication with the securing latch assembly 24 in order to be able to sense the condition or position of the latch member 26 in order to be able to sense whether the securing latch assembly is in the latched condition, and therefore the securing door 20 is latched by the latch assembly 24.

The sensing elements 50 may also include a movement sensor 54 which is configured to sense movement of the housing 12, and may comprise an accelerometer sensor capable of generating a movement signal indicative of the occurrence of any movement of the housing. The sensing element 50 may also include a biometric sensor 56 which is configured to sense at least one biometric characteristic of a person encountering the sensor 56. Illustratively, the biometric sensor 56 may be configured to sense characteristics of a fingerprint of a finger of the person. The biometric sensor 56 may be able to then generate an identification signal indicative of the particular biometric characteristics of the person.

The security container apparatus 10 may also include a first wireless communication interface 58 which is configured to transmit wireless communication signals, and may also be capable of receiving wireless communication signals. The first wireless communication interface 58 may be in communication with the microprocessor 32 in order to be able to transmit commands issued by the microprocessor and receive commands intended for the microprocessor.

The system 1 may also include an alarm apparatus 60 which may be configured to provide security to a premises or building structure, such as a home or residence or even a commercial space. In some embodiments, the alarm apparatus 60 may include a control keypad 62 which is configured to receive commands from a user for operation of the alarm apparatus 60, and may also be able to receive commands pertaining to the operation of the security container apparatus 10. The alarm apparatus 60 may also include a base station 64 which is physically separate of the security container apparatus 10, and may also be separate of the control keypad 62. The base station 64 may include a processor 66, and a second wireless communication interface 68 which is configured to communicate with the first wireless communication interface 58 of the security container apparatus 10. The second wireless communication interface 68 may thus transmit and/or receive signals representing commands to and from other wireless interfaces, such as the first wireless communication interface 58.

The base station may also include a perceptible alert device 70 which is configured to generate an alert that is perceptible to a person to be able to alert that person to a condition of the alarm apparatus or the container apparatus. Illustratively, the perceptible alert device 70 may be configured to generate an audible alert, and may comprise a siren, although other devices configured to generate other types of alerts that are perceptible to other human senses may be utilized. The base station 64 may also include a third wireless communication interface device 72 which is configured to communicate with a telecommunications network, such as a cellular telephone network, but optionally could communicate over a wired (POTS) telecommunications network. Via the communication network, the base station 64 may be able to dispatch messages regarding various conditions of the alarm system 1, including the alarm apparatus 60 and the security container apparatus 10. For example, the base station may be able to dispatch messages via email, text message, or via a web portal accessible via an information handling device such as a smartphone, a tablet or a computer.

The base station 64 may also include an interference sensor 74 which is configured to sense signal energy which has the potential to interfere with operation of the alarm apparatus 60 and possibly with respect to operation of the security container apparatus 10. Illustratively, the interference sensor 74 may be configured to sense a radio frequency signals or energy of a character would be effective to interfere with communications between the base station and the security container apparatus or communications between the base station and other elements of the alarm apparatus. The interference sensor 74 may also be sensitive to other types of potential interference, such as electromagnetic pulse (EMP) waves or energy which may be disruptive of the operation of elements of the system 1, and transmit such information to the processor 66, which may pass such information along via the third wireless communication interface 72 or may take other operational steps, such as triggering operation of the perceptible alert device 70.

In some embodiments, the alarm apparatus 60 may include a re-locking element 76 which is configured to cause the securing latch assembly 24 to move to the latched condition based upon the occurrence of one or more factors, such as the movement of the securing door from the open condition to the closed condition and the passage of time without a command being received to change the securing latch assembly from the latched to the unlatched condition, as well as possibly other factors.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more."

In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system comprising:

an alarm apparatus configured to provide security to at least a portion of a building structure; and a security container apparatus comprising:

a housing defining an interior for receiving objects, and having an opening from an exterior of the housing into the interior;

a securing door movable between a closed condition in which the door closes the opening in the housing against access to the interior and an open condition in which the door does not close the opening and does not restrict access to the interior of the housing;

control elements configured to control operation of the security container apparatus, the control elements being configured to control operation of aspects of the alarm apparatus, the control elements each being integrated into at least one of the housing and the securing door, the control elements including a subscriber identity module (SIM) card interface configured to receive a SIM card to receive information from the SIM card to authenticate the security container apparatus to the alarm system; and sensing elements configured to sense characteristics of the security container apparatus, the sensing elements being in communication with at least one element of the control elements.

2. The system of claim 1 wherein the control elements include:

a microprocessor; and wherein the subscriber identity module (SIM) card interface is in communication with the microprocessor to pass information from the SIM card to the microprocessor to authenticate the security container apparatus to the alarm system.

3. The system of claim 2 wherein the control elements include a keypad configured to receive commands from a user of the system, the keypad being configured to receive commands to be transmitted to the alarm apparatus.

4. The system of claim 2 wherein the control elements include:

a clock in communication with the microprocessor and being configured to output temporal information; and a display in communication with the microprocessor and being configured to display information.

5. The system of claim 2 wherein the control elements include memory in communication with the microprocessor and being configured to store audit trail information regarding accesses to the interior of the housing.

6. The system of claim 1 wherein the control elements include a microprocessor; and wherein the sensing elements are in communication with the microprocessor of the control elements, the control elements generating signals characteristic of conditions sensed for communication to the microprocessor.

7. The system of claim 1 wherein the housing has a securing latch assembly including:

a latch member mounted on a first one of the securing door and the housing, the latch member being movable with respect to the first one of the securing door and housing to engage a second one of the securing door and the housing to change the securing latch member between a latched position corresponding to the latched condition and an unlatched position corresponding to the unlatched condition; and a latch actuator configured to act upon the latch member to move the latch member between the latched position and the unlatched position.

8. The system of claim 1 wherein the sensing elements include a door condition sensor configured to sense a condition of the securing door with respect to the opening, the door condition sensor being configured to detect if the securing door is in at least one of the closed and open conditions, the door condition sensor being configured to generate a door condition signal indicative of the condition of the door for communication to a microprocessor of the control elements.

9. The system of claim 1 wherein the sensing elements include a movement sensor configured to sense movement of the housing, the movement sensor being configured to generate a movement signal indicative of any movement of the housing for communication to a microprocessor of the control elements.

10. The system of claim 9 wherein the movement sensor comprises an accelerometer.

11. The system of claim 1 wherein the sensing elements include a biometric sensor configured to sense at least one biometric characteristic of a person encountering the sensor, the biometric being configured to generate an identification signal indicative of the biometric characteristic of the person for communication to a microprocessor of the control elements.

12. The system of claim 1 wherein the security container apparatus additionally comprises a first wireless communication interface configured to transmit wireless communication signals.

13. The system of claim 12 wherein the first wireless communication interface is configured to receive wireless communication signals.

14. The system of claim 1 wherein the alarm apparatus comprises a control keypad configured to receive commands from a user for operation of the alarm apparatus.

15. The system of claim 1 wherein the alarm apparatus comprises a base station separate of the security container apparatus, the alarm base station comprising:

a processor; and a second wireless communication interface configured to communicate with the security container apparatus, the second wireless communication interface being configured to receive signals from a first wireless communication interface of the security container apparatus, the second wireless communication interface being configured to transmit signals to the first wireless communication interface.

16. The system of claim 1 wherein the alarm apparatus comprises a perceptible alert device configured to generate an alert perceptible to a person to alert the person to a condition of the container apparatus.

17. The system of claim 1 wherein the alarm apparatus comprises an interference sensor configured to sense signal energy with a potential to interfere with operation of the alarm apparatus.

18. The system of claim 17 wherein the interference sensor is configured to sense radiofrequency signals of a character effective to interfere with communications between a base station of the alarm apparatus and the security container apparatus.

19. The system of claim 18 wherein the interference sensor is configured to sense radiofrequency signals of a character effective to interfere with communications between the base station of the alarm apparatus and other elements of the alarm apparatus.

20. The system of claim 15 wherein the alarm apparatus comprises a third wireless communication interface configured to communicate with a telecommunications network to dispatch messages regarding various conditions of the security container apparatus.

* * * * *